United States Patent [19]

Maciorowski

[11] Patent Number: 4,522,403

[45] Date of Patent: Jun. 11, 1985

[54] BALANCE TOY

[76] Inventor: Michael W. Maciorowski, 5421 S. Keeler Ave., Chicago, Ill. 60632

[21] Appl. No.: 565,382

[22] Filed: Dec. 27, 1983

[51] Int. Cl.[3] ..... A63F 9/08

[52] U.S. Cl. ..... 273/154; 273/155

[58] Field of Search ..... 273/1 GF, 154, 155; 446/325, 326

[56] References Cited

U.S. PATENT DOCUMENTS

| | | | |
|---|---|---|---|
| 479,158 | 7/1892 | Smallwood | 273/154 |
| 496,716 | 5/1893 | Benitez | 273/154 |
| 2,458,306 | 1/1949 | Schneider | 273/1 GF UX |
| 3,559,989 | 2/1971 | Breslow | 273/1 GF |
| 3,614,106 | 10/1971 | Morrison et al. | 273/1 GF X |
| 3,805,444 | 4/1974 | Adickes | 446/325 X |

*Primary Examiner*—Anton O. Oechsle

*Attorney, Agent, or Firm*—Stephen A. Litchfield; Carmen B. Patti

[57] ABSTRACT

A balance toy in the form of a body having a top portion, a bottom portion and a plurality of sections therebetween. The intermediate sections are rotatable with respect to each other about a common axis in the form of an elongated rod connecting the top and bottom portions. At least some of the sections are provided with a weighted portion spaced from the axis. The toy will be tilted unless the weighted portions are arranged so as to counterbalance each other.

9 Claims, 5 Drawing Figures

BALANCE TOY

BACKGROUND OF THE INVENTION

This invention relates generally to toys, and more particularly to puzzle toys.

Many toys exist which require skill and the use of memory to achieve a particular result in the operation of the toy. One example is the cube toy which consists of a toy having moveable sections, the goal being to line up all the sections having the same color on a side of the cube. Other toys are illustrated in various patents.

In the patent to Presby, U.S. Pat. No. 3,717,942 a rotatable amusement and education device is disclosed which has a central axis with a variety of rings therearound, each ring having a multi-sided outer surface. Each of these multi-sided outer surfaces have a picture which, when properly aligned with the multi-sided surfaces of the other rings, forms a completed picture.

The patent to Lewis, U.S. Pat. No. 2,931,657 for pictorial toys illustrates a series of rotatable rings placed within a cylindrical container, each ring having various drawings thereon. The cylindrical container has an open section through which the drawings on the rings may be viewed. The drawings are made up of various parts of the anatomy of a person such that when each is rotated with respect to the others and the drawings aligned, various comic configurations can be formed by the rings.

The patent to Benitez for a columbian egg puzzle, U.S. Pat. No 496,716 discloses an egg shaped toy having moveable weighted balls inside which, when rolled through a maze and into the proper positions, will balance the toy on one end. The patent to Smallwood for a toy or puzzle, U.S. Pat. No. 479,158 discloses another egg shaped toy divided into two half sections, each half section having a weight fixed therein, each half section moveable about a common axis. When the half sections are rotated with respect to each other and the weights are counterbalanced, the egg will balance on its end.

SUMMARY OF THE INVENTION

It is an object of the present invention to provide a balance toy having multiple, moveable rings centered about a common axis, each ring having a weighted portion therein, which when properly counterbalanced, will balance the toy.

It is a further object of the invention to provide a balance toy having a means for indicating when the toy is precisely balanced.

The balance toy disclosed herein comprises a series of moveable rings, each ring having a portion therein which contains a weight. Each ring having a common central axis about an elongated rod. Each ring is fitted around the rod and is moveable with respect to the other weighted rings about the rod. The bottom ring has a rounded bottom which causes the toy to tilt when the weighted portions of the individual rings are not properly counter-balanced. When the rings are manipulated to arrange the weighted portions with respect to each other so that each are counter-balanced, the toy will balance and stand straight up.

The multiple, moveable rings are held together by the rod. Each of the rings have a diameter different from the next adjacent ring. The weights in the rings are located at the outer most points of each ring thus creating the maximum moment from the central axis of the rod. Since the bottom of the toy is rounded to provide an uneven surface, the toy will wobble and tilt to one side when not correctly balanced. To further indicate when the toy is precisely balanced a bubble level is located at the top of the toy. This bubble level is located such that the center point of the level is in line with the central axis of the toy. When the toy is perfectly balanced it will remain upright with the bubble of the bubble level in the center portion of the level.

The location of the weight in each ring may be arranged such that it is not ascertainable to the person using the toy. Thus the person using the toy must remember which direction he turned each ring in the previous attempt to balance the toy. In this sense the balancing of the toy requires the use of the users memory to properly adjust the weighted rings. When all of the weights are arranged to counteract each other the toy will balance.

With these and other objects to be hereinafter set forth, I have devised the arrangement of parts to be described and more particularly pointed out in the claims appended hereto. In the accompanying drawings, wherein an illustrative embodiment of the invention is disclosed, FIG. 1 is a front perspective view of the balance toy, showing the toy balanced on a table top;

The features of the present invention which are believed to be novel are set forth with particularity in the appended claims. The invention together with further objects and advantages may best be understood by reference to the following description taken in conjunction with the accompanying drawings.

DETAILED DESCRIPTION

Figure 1:
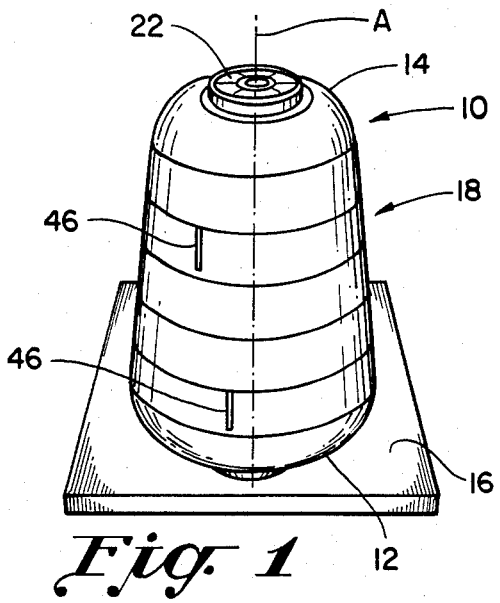

The balance toy is depicted generally in FIG. 1 of the drawings. Balance toy 10 is shown in a perspective view having a rounded bottom 12 and a rounded top 14. Central axis A is shown passing through the center of balance toy 10 and is shown vertically oriented with respect to table top 16. Central axis A has located therearound multiple, moveable rings 18 the balance toy 10 is shown with circular level 22, also called bubble level 22.

Figure 2:
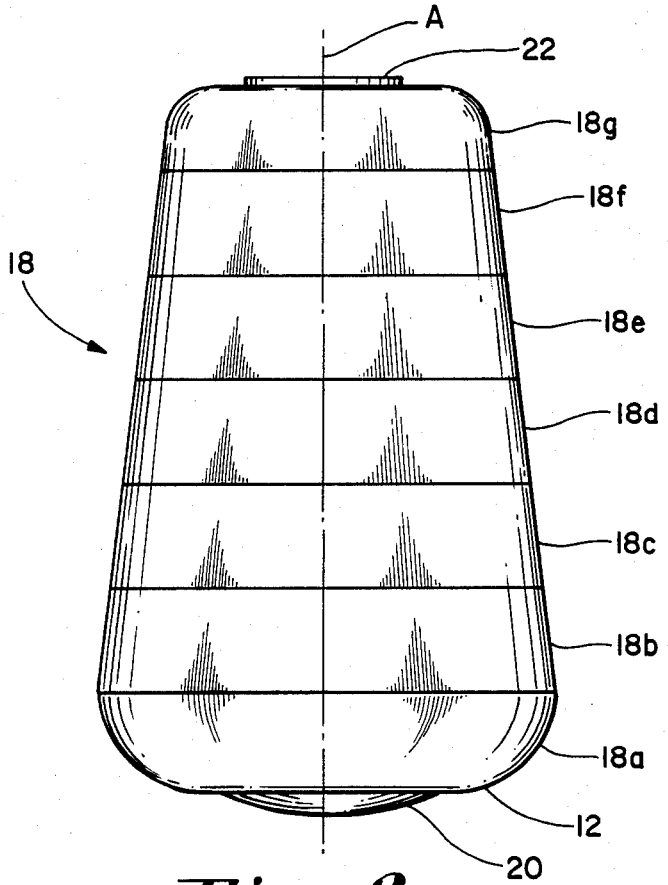
FIG. 2 is a front elevational view of the balance toy constructed according to the invention.

FIG. 2 shows in more detail the arrangement of rings 18 around central axis A. Rings 18 range from ring 18*a* through ring 18*g*, each ring showing a progressively narrower diameter from 18*a* through 18*g*.

Figure 3:
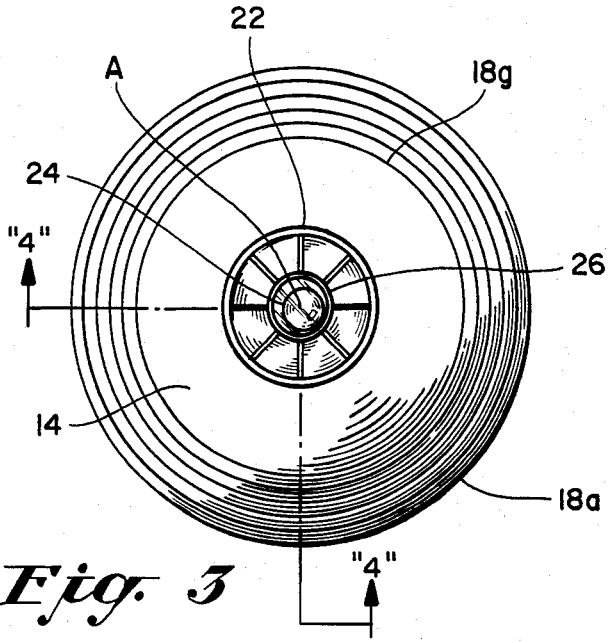
FIG. 3 is a top view of the balance toy.

In FIG. 2, rounded bottom 12 has centrally located second rounded bottom 20 located in line with central axis A. Rings 18*a* through 18*g* are centrally located around axis A. Each ring 18 is moveable axially about axis A independent of each other ring 18. FIG. 3 shows in more detail the bubble level 22 having an air bubble 24 therein and balance indicator 26. Bubble level 22 is preferrably a transparent, plastic container filled with water or some other liquid. In the level 22 shown in FIG. 3, the container is circular and has a circle inscribed on the top thereof. This inscribed circle has been identified above as balance indicator 26. A small portion of the container is left unfilled, thus forming the air bubble 24. When the bubble level is perfectly level the air bubble 24 will position itself in the center of the level 22. Since bubble balance indicator 26 is a circle drawn around the exact center point of bubble level 22, when balance toy 10 is perfectly balanced, the bubble 24 will be within the circle of balance indicator 26. This will indicate that the balance toy 10 is precisely balanced. Balancing the toy 10 such that the bubble 24 is within the balance indicator 26 is the object of the toy in this embodiment.

It should be noted that balance indicator 26 need not be circular in shape. It could take on a variety of forms, each one designed to indicate that the air bubble 24 is directly over the central axis A.

FIG. 3 illustrates in more detail the ascending and reducing diameter of each ring 18 from the bottom most ring 18*a* to the top most ring 18*g*. In the FIGS. 1 through 3 generally, there is no indication of the position of the weighted area of each ring. However, in FIG. 1, weight indicators 46 could be added to the rings 18, (shown here on only two rings) indicating the location of each weight in each ring. This would help the user balance the toy since the location of each weight in each ring would be known. As a further variant, less than all of the rings 18 could have weight indicators 46 thereon, to give some assistance to the user in balancing the toy 10, but also maintaining an element of the unknown with respect to the unmarked rings.

Figure 4:
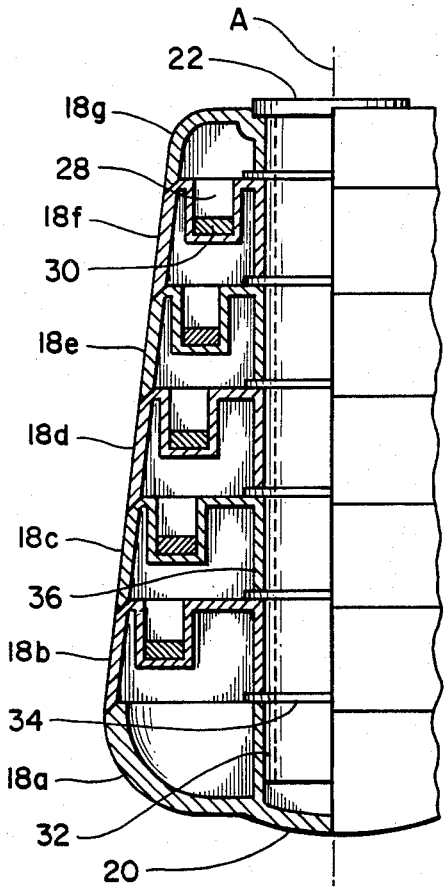
FIG. 4 is a partial section view of the balance toy taken substantially on the line 4—4 of FIG. 3 looking in the direction of the arrows.

FIG. 4 shows in a partial section view the structure of rings 18*a* through 18*g* taken along line 4—4 of FIG. 3. Also, FIG. 4 shows in detail the assembled balance toy 10 with its interior component parts. In FIG. 4 it is seen that each ring 18 has opening 28 placed towards the outermost portion of the ring. In each opening 28 is placed a weight 30. Each ring 18 is arranged around rod 32 which provides the connection means for each ring and the means about which each ring is rotated around central axis A. To provide ready movement of one ring with respect to the other, each ring has therebetween washer 34. It should be noted that in one embodiment, when assembled, the weights 30 are not visible to the user of the toy 10. Each ring 18 carries a weight 30 in one position only. Thus, when each ring 18 is rotated with respect to the other rings the weights 30 may be distributed unevenly around central axis A. This causes balance toy 10 to become unstable and to tilt towards the direction of the greatest combination of weights 30 due to the rounded second bottom portion 20. Of course, when the toy 10 is out of balance the bubble 24 of circular level 22 will be outside of the balance indicator 26, indicating that the toy 10 is out of balance. As the various rings 18 are manipulated with respect to each other and the weights 30 redistributed about central axis A, the bubble 24 will indicate a new reading on the balance indicator 26.

Each ring 18 is arranged about rod 32 such that there is a close fit as shown in FIG. 4. Inner portion 36 of each ring 18 lies snuggly against the cylindrical rod 32. Not only does this provide a close fit as mentioned above, it also prevents the rings 18 from turning independent of one another unless they are actually manipulated by the user. It should be noted that FIG. 4 is shown with no weight 30 deposited in ring 18*a*. Since ring 18*a* is shown integrally connected to rounded bottom 12 and second rounded bottom 20, one design choice would feature the elimination of a weight in this area. This will reduce manufacturing costs and assembly costs of the balance toy 10. However, if so desired, a greater degree of variability and unpredictability can be given to the toy 10 by adding a weight 30 and an opening 28 to ring 18*a*. Likewise, ring 18*g* at the top of balance toy 10 is shown in FIG. 4 without a corresponding weight 30 or opening 28. Again, by eliminating the opening 28 and weight 30 in this area, manufacture and assembly costs are minimized. However, if a greater degree of skill to balance the toy is desired, a weight 30 and opening 28 could be added to ring 18*g* to increase the difficulty in balancing the toy 10. It should be appreciated from reviewing the cut-away section of FIG. 4 that the fewer the number of weights, the easier it will be to balance the toy 10 by manipulating the rings 18 that contain the weights 30.

In the embodiment disclosed there are five weights in five of the seven rings 18. The lower rings 18*b* and 18*c* are disposed a greater distance from central axis A. The movement of the rings 18*b* and 18*c* will produce a greater effect on the balancing of toy 10 than the manipulation of the rings 18*e* and 18*f*, since these rings are located a lesser distance from the central axis A. Thus, a fine tuning effect is developed by the location of the weights 30 in a vertical orientation with respect to axis A. The greater the distance of the weight 30 located on the ring 18 from central axis A, the greater the effect in balancing the toy 10 from minor movements of those rings. The lesser the distance of the weight 30 from the central axis A the more minute the effect of the rotation of the ring 18 containing that weight 30. The toy 10 can be fine tuned by generally locating the bubble 24 with respect to the balance indicator 26 and then attempting to move the bubble 24 into the balance indicator 26 by turning the upper rings of the toy. Obviously, when the toy 10 is severely out of balance, such a condition will be apparent to the user without looking at the balance indicator 26. In such a state the toy 10 will severly tilt to one side. It is when the toy 10 is slightly out of balance that the balance indicator 26 becomes important and the position of bubble 24 with respect to the balance indicator 26 is observed. As the toy 10 gets closer to being precisely balanced the user keeps track of the positions of the bubble 24 with respect to the balance indicator 26. Once the bubble 24 is located in the center of the balance indicator 26, when the toy is at rest, the toy will be balanced.

In balancing the toy 10 the rings are manipulated by rotating them with respect to one another. The toy is then held in a balanced position and released. The toy will wobble until it stablizes. When it stablizes it will either be out of balance or in balance. If it is out of balance the rings 18 are then manipulated again to attempt to balance the toy 10. As can be appreciated, there are an infinite number of arrangements of the weighted rings 18 possible to balance toy 10.

Figure 5:
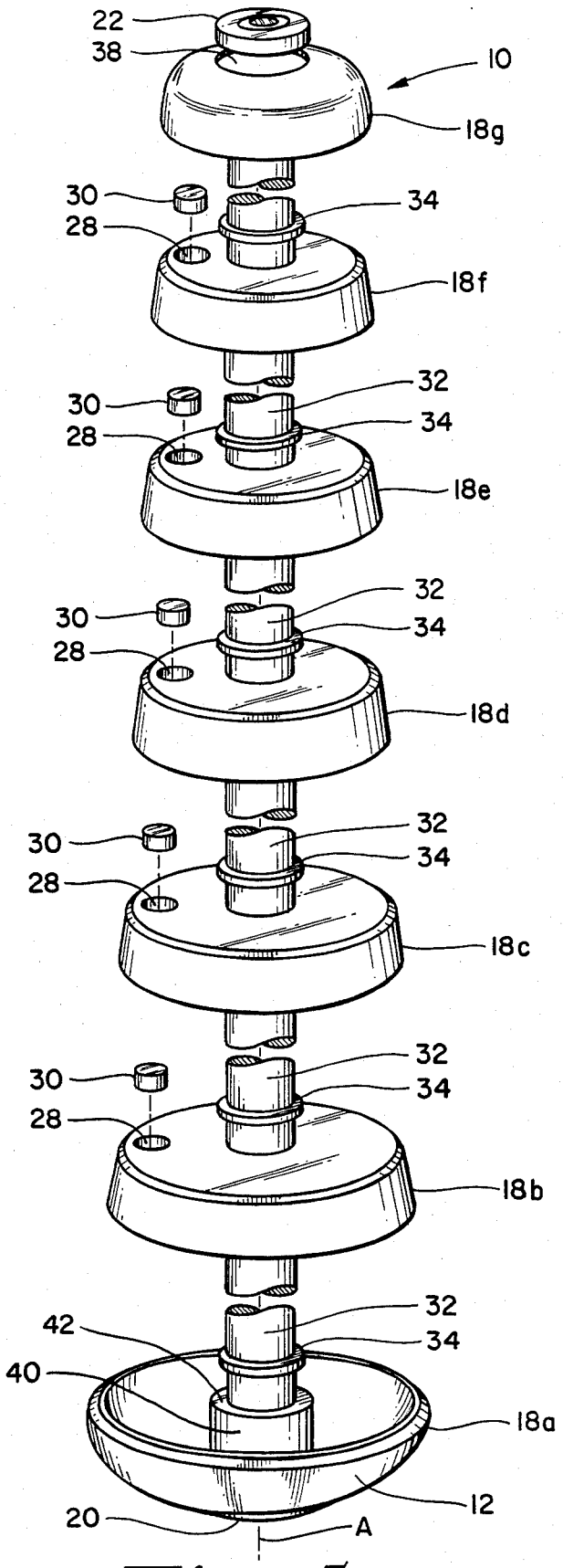
FIG. 5 is an exploded perspective view of the balance toy showing in detail the various parts that comprise this embodiment of the invention.

FIG. 5 shows an exploded view of the elements of balance toy 10. In this view it is seen that rod 32 is placed into rod receiving portion 40 of ring 18*a*. Over rod 32 is placed the first washer 34 which rests against rod receiving portion 40 of ring 18*a*. Rod receiving portion 40 has an opening therein to securely and snugly receive rod 32. Rod 32 may be fixed within portion 40 by a glue or other sealant. Rod receiving portion 40 has a flat face 42 against which washer 34 rests. Ring 18*b* is then placed over rod 32 and washer 34 such that the outer end of ring 18*b* meets with the outer surface of ring 18*a*. Weight 30 is placed in opening 28 in ring 18*b*, a second washer 34 is then placed over rod 32 and adjacent the top side of ring 18*b*. Ring 18*c* is placed over rod 32 and adjacent the second washer 34. Weight 30 is placed in opening 28 of ring 18*c* and a third washer 34 is then placed over rod 32 and adjacent the top side of ring 18*c*. Ring 18*d* is placed over rod 32 such that it is adjacent the top side of ring 18*c* and the third washer 34. Another weight 30 is placed in opening 28 of ring 18*d* and a fourth washer 34 is placed thereover.

Ring 18*e* is placed over rod 32 and adjacent the fourth washer and ring 18*d*. Weight 30 is placed in opening 28 of ring 18*e* and a fifth washer 34 is placed over rod 32 and adjacent the top side of ring 18*e*. Ring 18*f* is then placed over rod 32 and adjacent ring 18*e* and the fifth washer 34. Weight 30 is placed in opening 28 of ring 18*f* and a sixth washer 34 is placed over rod 32 and adjacent the top side of ring 18*f*. Ring 18*g* is then secured on rod 32, adjacent the top side of ring 18*f* and the sixth washer 34. Again, a glue or other sealant may be used to fix ring 18*g* to rod 32. Bubble level 22 is fixed in opening 38 of ring 18*g* such that central axis A passes through the exact center portion of the balance indicator 26 of bubble level 22. Bubble level 22 can be glued into opening 38 or opening 38 can be designed such that a friction fit between the bubble level 22 and the opening 38 is achieved.

It should be noted that by placing the rings 18 on top of each other, weights 30 are effectively sealed in openings 28 and may not be dislodged. Washers 34 facilitate the movement of the rings 18 independent of one another about cylindrical rod 32.

The invention is not limited to the particular details of assembly and structure as above disclosed. Other modifications and applications may be contemplated and other objects and advantages may be realized without departing from the true spirit and scope of the invention herein claimed. For example, the number of rings 18 may be increased or decreased depending on the degree of complexity desired in balancing the toy 10. It should be realized that the greater the number of weighted rings 18 the more difficult it will be to balance the toy 10. Also, the distance of the weights 30 from the axis A on a particular ring 18 will determine the effect moving that ring with respect to the other rings will have on the overall balance of the toy. Also, it would be possible to add multiple weights to a given ring 18 spaced unevenly thereon. By so doing it would complicate the balancing of the toy. Further, the amount of weight in each ring, can be varied to increase the difficulty in balancing the toy. In addition, as indicated earlier, markings could be added to the outside of each ring to indicate the location of the weight 30 in the ring to help the user in remembering where one ring was with respect to the other rings prior to the next subsequent movement of the rings. Also, different means for determining whether the toy is precisely level or balanced could be used other than the circular bubble level. Similarly, different means could be used to cause the toy to tilt and wobble rather than the rounded bottom as disclosed herein. It is intended therefore that the subject matter in the above disclosure shall be interpreted as illustrative and not in a limiting sense.

I claim:

1. A balance toy comprising a body having a top portion and a bottom portion and having a plurality of sections mounted therebetween, each said section moveable with respect to the other about a common axis, said common axis comprising an elongated rod connecting the top portion and the bottom portion and maintaining the sections adjacent each other between the top and bottom portions, at least two of said sections having a weighted portion spaced from said axis; and means for causing said toy to tilt when said weighted portions are not arranged so as to counter balance one another.

2. The balance toy of claim 1 where said tilt means comprises a rounded bottom section centrally located under said common axis.

3. The balance toy of claim 1 including means for determining when said toy is precisely counter-balanced.

4. The balance toy of claim 3 where said determining means comprises a bubble level secured over the central axis of the toy such that when said weights are counter-balanced the bubble level will indicate that the toy is balanced.

5. A balance toy comprising an elongated rod having arranged therearound mutiple, moveable rings, said rod comprising a central axis for said rings, each said ring having a weighted portion thereon and each said ring moveable with respect to the other rings; means for tilting the toy when all of said weighted portions are not counter-balanced; and means for indicating when said toy is precisely balanced.

6. The balance toy of claim 5 where said tilt means comprises a rounded bottom section centrally located under said common axis and in contact with a support surface, such as a table top, causing said balance toy to tilt when said weighted portions are not counter balanced.

7. The balance toy of claim 5 where said balance indicator means comprises a bubble level centrally located over said common axis.

8. The balance toy of claim 5 where at least one ring has a marking thereon, said marking indicating the location of the weighted portion of the ring.

9. The balance toy of claim 5 where the weighted portions of each ring are located at differing distances from the central axis such that the manipulation of each ring produces a different response in the balance of the toy than a similar manipulation of another ring.

* * * * *